US011045704B2

(12) United States Patent
Givens

(10) Patent No.: US 11,045,704 B2
(45) Date of Patent: Jun. 29, 2021

(54) ADJUSTABLE WALL MOUNT ASSEMBLY FOR A BASKETBALL GOAL

(71) Applicant: MEGA SLAM HOOPS, LLC, San Antonio, TX (US)

(72) Inventor: Jon C. Givens, Katy, TX (US)

(73) Assignee: MEGA SLAM HOOPS, LLC, San Antonio, TX (US)

( * ) Notice: Subject to any disclaimer, the term of this patent is extended or adjusted under 35 U.S.C. 154(b) by 0 days.

(21) Appl. No.: 15/823,679

(22) Filed: Nov. 28, 2017

(65) Prior Publication Data

US 2018/0229093 A1 Aug. 16, 2018

Related U.S. Application Data

(60) Provisional application No. 62/458,054, filed on Feb. 13, 2017.

(51) Int. Cl.
*A63B 63/08* (2006.01)
*A63B 71/02* (2006.01)

(52) U.S. Cl.
CPC ..... *A63B 63/083* (2013.01); *A63B 71/023* (2013.01); *A63B 2225/093* (2013.01); *A63B 2243/0037* (2013.01)

(58) Field of Classification Search
CPC ..... A63B 63/083; F16M 11/046
USPC ..... 473/484
See application file for complete search history.

(56) References Cited

U.S. PATENT DOCUMENTS 2,313,188 A * 3/1943 Woodburn ..... A63B 63/083 473/484
3,765,676 A * 10/1973 Bearson ..... A63B 63/083 248/281.11
3,802,702 A * 4/1974 Pulley ..... A63B 63/083 248/284.1
4,330,101 A * 5/1982 Andersen ..... A63B 63/083 248/284.1
4,395,040 A * 7/1983 White ..... A63B 63/083 248/284.1
6,419,598 B1 7/2002 Winter et al.
7,290,744 B2 * 11/2007 Baldasari ..... A63B 63/083 248/123.11

(Continued)

FOREIGN PATENT DOCUMENTS

KR 20090061196 A 6/2009

OTHER PUBLICATIONS

Goalsetter GS72 Adustable Height Goal System, Installation and Owner's Instructions, copyright 2006.*

(Continued)

*Primary Examiner* — Laura Davison
(74) *Attorney, Agent, or Firm* — Nolte Lackenbach Siegel

(57) ABSTRACT

An adjustable wall mount assembly for a basketball goal is provided. The adjustable wall mount assembly may include a frame, a pair of supports, an actuator, a pair of actuator brackets, and a support bracket. The pair of support brackets may each be rotatably coupled to a respective side member of the frame and adapted to be rotatably coupled to a backboard. The pair of actuator brackets may be rotatably coupled to the frame and the actuator. The support bracket may be adapted to be rotatably coupled to the backboard of the basketball goal, rotatably coupled to the frame, and rotatably coupled to the actuator.

17 Claims, 4 Drawing Sheets

(56) References Cited

U.S. PATENT DOCUMENTS

| | | | | |
|---|---|---|---|---|
| 8,523,715 | B2 | 9/2013 | Elpers | |
| 8,708,844 | B2 * | 4/2014 | Nye | A63B 63/083 473/484 |
| 8,992,350 | B2 * | 3/2015 | Green | A63B 63/083 473/484 |
| 9,675,859 | B2 | 6/2017 | Green et al. | |
| 2013/0005514 | A1 * | 1/2013 | Green | A63B 63/083 473/484 |

OTHER PUBLICATIONS

First Team, Inc. WallMonster Series Installation Instructions, http://www.firstteaminc.com/pdfstore/261-AssemblyInstructions.pdf, captured Apr. 1, 2013.*

PCT Notification of Transmittal of International Search Report and the Written Opinion of the International Searching Authority dated Jun. 20, 2018, issued from the International Searching Authority in related PCT Application No. PCT/US2017/063568 (11 pages).

PCT Notification Concerning Transmittal of International Preliminary Report on Patentability(Chapter I of the Patent Cooperation Treaty) dated Aug. 22, 2019 issued from the International Bureau of WIPO in realted PCT Application No. PCT/US2017/063568 (8 pages).

Goalsetter, 'GS72/GS60/GS54 Installation and Owners Instructions' (online). Jan. 2015, (retrieved on Apr. 25, 2018), Retrieved from the Internet: <URL: http://www.goalsetter.com/16/wall-mount-basketball-hoop/gs60-wall-mount.html>, pp. 1-12.

* cited by examiner

ADJUSTABLE WALL MOUNT ASSEMBLY FOR A BASKETBALL GOAL

CROSS-REFERENCE TO RELATED APPLICATIONS

This application claims the benefit of U.S. Provisional Patent Application having Ser. No. 62/458,054, which was filed Feb. 13, 2017. The aforementioned patent application is hereby incorporated by reference in its entirety into the present application to the extent consistent with the present application.

BACKGROUND

Basketball goals are frequently used in areas outside of professional basketball arenas. These basketball goals are typically mounted to a pole or wall, and may include a mechanism to adjust the height of the goal. While such basketball goals are functional, the mounting system for wall mounted goals typically runs through the middle of the backboard. Unlike the goals used in professional basketball arenas, the view through the backboard of a typical adjustable, wall-mounted goal is obstructed by one or more cross members running across the back of the backboard. What is needed, therefore, is a wall mount for an adjustable basketball goal that provides an unobstructed view though the backboard, providing an experience closer to that of a professional basketball arena.

SUMMARY

Embodiments of the disclosure may provide an adjustable wall mount assembly for a basketball goal. The adjustable wall mount assembly may include a frame having opposing side members, a pair of supports, an actuator, a pair of actuator brackets, and a support bracket. Each support may be rotatably coupled to a respective side member of the frame at a first end and adapted to be rotatably coupled to a backboard at a second end. Each actuator bracket may be rotatably coupled to the frame at one end thereof and rotatably coupled to the actuator at a second end thereof. The support bracket may be adapted to be rotatably coupled at a first end thereof to the backboard, rotatably coupled to the frame at a second end thereof, and rotatably coupled to the actuator at a point intermediate the first and second ends thereof.

Embodiments of the disclosure may further provide an adjustable basketball goal. The adjustable basketball goal may include a backboard and a wall mount assembly. The backboard may include a backboard frame, a panel retained by the backboard frame, and a rim assembly coupled to the backboard frame. The wall mount assembly may include a frame having opposing side members, a pair of supports, an actuator, a pair of actuator brackets, and a support bracket. Each support may be rotatably coupled to a respective side member of the frame at a first end and rotatably coupled to the backboard at a second end. Each actuator bracket may be rotatably coupled to the frame at one end thereof and rotatably coupled to the actuator at a second end thereof. The support bracket may be rotatably coupled at a first end thereof to the backboard, rotatably coupled to the frame at a second end thereof, and rotatably coupled to the actuator at a point intermediate the first and second ends thereof.

Embodiments of the disclosure may further provide an adjustable basketball goal. The adjustable basketball goal may include a wall mount assembly and a backboard. The wall mount assembly may include a frame, a first actuator bracket, a second actuator bracket, a first support, a second support, a support bracket, and an actuator. The first actuator bracket and the second actuator bracket may each be rotatably coupled to the frame. The first support, the second support, and the support bracket may each have a first end that is rotatably coupled to the frame. The actuator may include an outer cylinder and an inner rod. The outer cylinder may be rotatably coupled to the support bracket. The inner rod maybe partially disposed within the outer cylinder and rotatably coupled to the first actuator bracket and the second actuator bracket. The backboard may include a backboard frame, a panel, and a rim assembly. The backboard frame may include a first side member, a second side member, and a mounting bracket. The first side member may be rotatably coupled to a second end of the first support, the second side member may be rotatably coupled to a second end of the second support, and the mounting bracket may be rotatably coupled to a second end of the support bracket. The panel may be retained by the backboard frame and the rim assembly may be coupled to the backboard frame.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
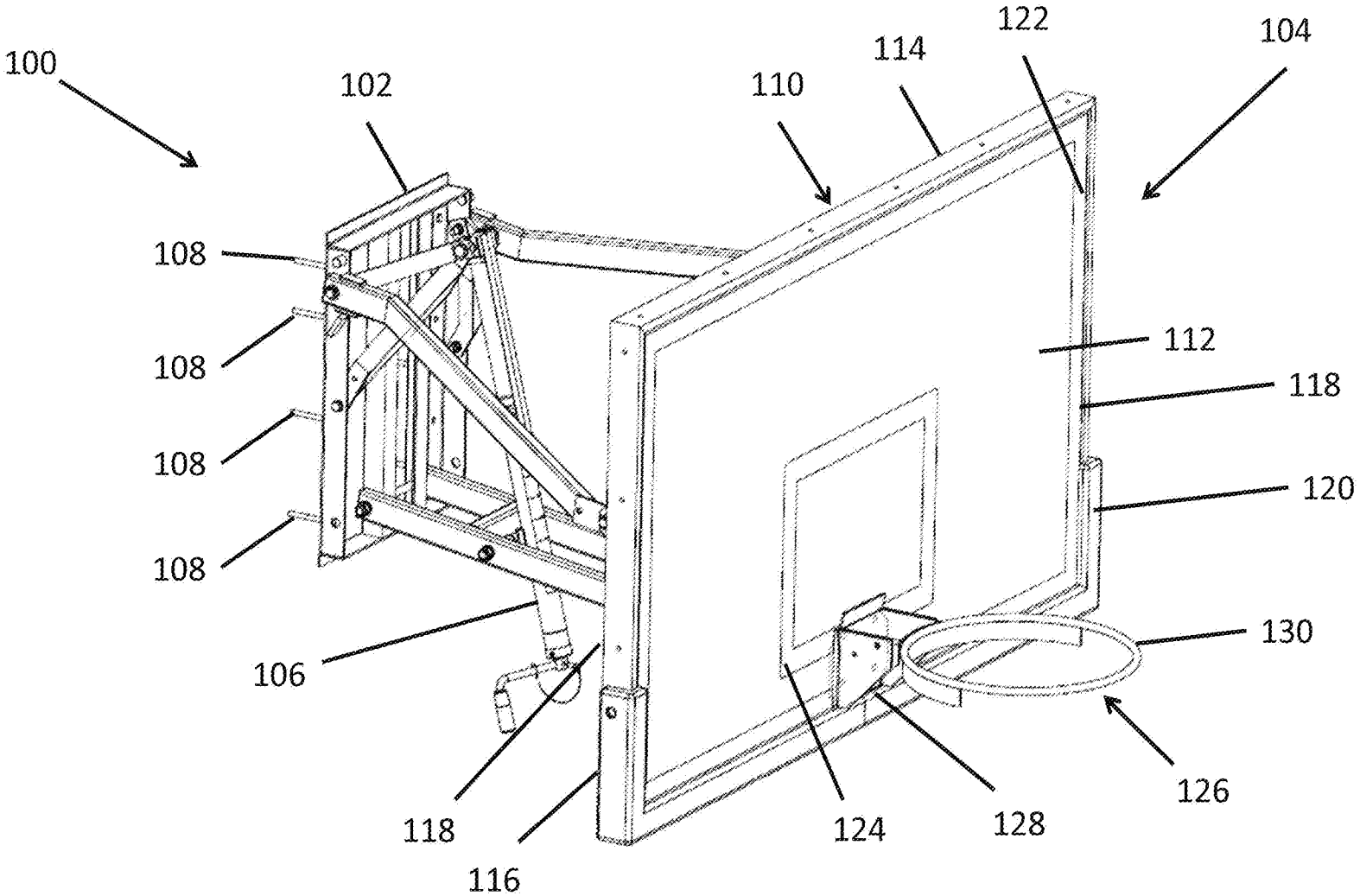
FIG. 1 illustrates an isometric view of an adjustable, wall-mounted basketball goal, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates an isometric view of an adjustable, wall-mounted basketball goal 100, according to one or more embodiments of the present invention. The adjustable wall-mounted basketball goal 100 may include an adjustable wall mount assembly 102 and a backboard 104. The adjustable wall mount assembly 102 may include an actuator 106, which will be discussed in greater detail with reference to FIG. 2 below. The adjustable wall mount assembly 102 may be removably coupled to a wall or support structure (not shown) using fasteners 108 such as anchors, screws, or bolts.

The example embodiment illustrated in FIG. 1 includes four fasteners 108 on each of the side of the adjustable wall mount assembly 102. The fasteners 108 are used to removably mount the basketball goal 100 to a wall. Other embodiments may have two, three, five, or more fasteners 108 on each side, or have fasteners 108 on all four sides of the adjustable wall mount assembly 102. In other embodiments, the fasteners 108 may be omitted and the adjustable wall mount assembly 102 may be permanently affixed to the wall or support structure through welding or other similar methods.

The backboard 104 may include a backboard frame 110 surrounding a panel 112. In some embodiments, the backboard frame 110 may include a top member 114, a bottom member 116, and two side members 118. In other embodiments, the backboard frame 110 may include a lower, u-shaped member (not shown) positioned around the perimeter of the panel 112 and a top member 114. The individual members 114, 116, 118 may be coupled together using fasteners, welds, or other similar means.

The backboard frame 110 may include an outer frame that is coupled to a structural inner frame (not shown). The outer frame and inner frame may be coupled to one another using bolts, adhesives, welds, or other similar means. The outer frame may be made of aluminum or other similar lightweight material and the inner frame may be made of steel, iron, or other similar metal. The frame 110 may further include a bumper 120 coupled to the bottom member 116 and at least a portion of the side members 118. The bumper 120 may be made out of rubber, foam, or other similar material, as is known in the art.

The backboard frame 110 may further include a groove (not shown) on the interior surface 122 configured to receive and retain the panel 112. The panel 112 may be inserted into the groove prior to the top member 114 being coupled to the side members 118. Other embodiments of the backboard frame 110 may have an inner shelf in addition to, or in place of, the groove that provides a surface to bond the panel 112 to the backboard frame 110 using glue, epoxy, and the like.

The panel 112 may be made of a clear material, such as glass, tempered glass, plexiglass, or polycarbonate. This may allow a clear view through the panel 112. Additionally, a variety of suitable materials are known in the art for this purpose and any such material may be used for the panel 112. The panel 112 may further include a horizontally centered and vertically offset square or rectangular target 124. The target 124 may be painted onto the panel 112, etched into the panel 112, or may be a sticker adhered to the panel 112.

As shown in FIG. 1, a rim assembly 126 may be coupled to the backboard 104. The rim assembly 126 may include a mounting plate 128 and a hoop 130. The mounting plate 128 may be coupled to the backboard frame 110 using bolts, adhesives, welds, or other similar means. The mounting plate 128 may also be coupled to the panel 112 using bolts or adhesives. In some embodiments, a cloth or chain net (not shown) may be attached to the hoop 130.

The rim assembly 126 may be a fixed type rim assembly as shown in the exemplary embodiment, with the mounting plate 128 and hoop 130 rigidly coupled together. In other embodiments, the rim assembly 126 may be a collapsible style rim assembly. A collapsible style rim assembly may allow the hoop 130 to flex independently of the mounting plate 128, allowing the rim assembly 126 to absorb some of the force when the hoop 130 is pulled.

Figure 2:
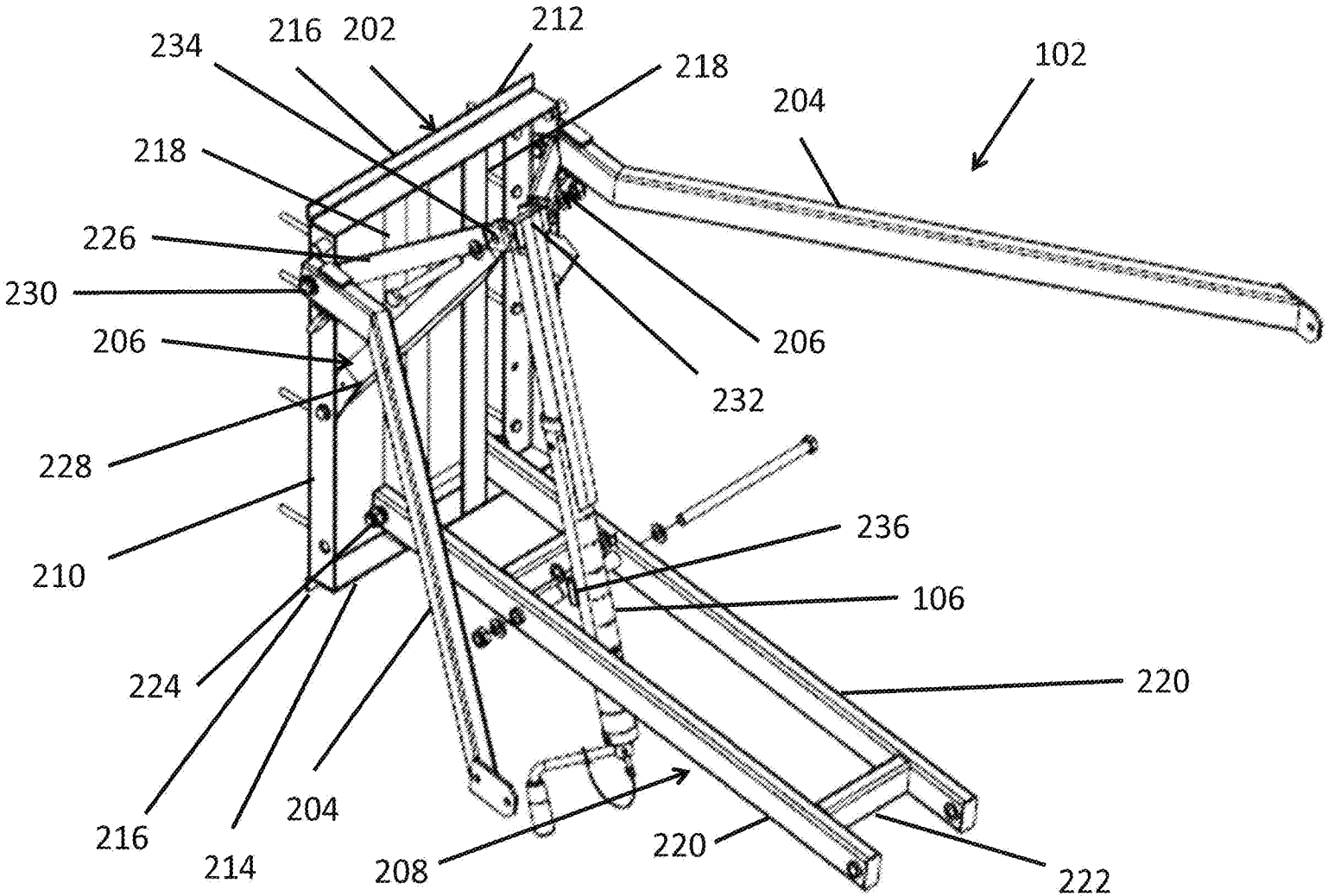
FIG. 2 illustrates the adjustable wall mount assembly of FIG. 1 with the backboard omitted.

Referring now to FIG. 2, with continued reference to FIG. 1, FIG. 2 illustrates the adjustable wall mount assembly 102 of FIG. 1 with the backboard 104 omitted. The adjustable wall mount assembly 102 may include a frame 202, two supports 204, two actuator brackets 206, a lower support bracket 208, and the actuator 106. In the example embodiment illustrated in FIG. 2, the frame 202 is rectangular; however, other embodiments of the frame may be an oval or other geometric shape. Other embodiments of the adjustable wall mount assembly 102 may include more than two supports 204 and actuator brackets 206, more than one lower support bracket 208, or any combination thereof.

The frame 202 may include two side members 210 (one shown), a top member 212, and a bottom member 214. The side members 210, top member 212, and bottom member 214 may be coupled together using fasteners, welds, or other similar means. The top member 212 and bottom member 214 may each have a flange 216 extending away from the frame 202. In other embodiments, the flange 216 may be omitted.

The frame 202 may further include two vertical members 218 extending between the top member 212 and the bottom member 214, and coupled to the frame 202 using fasteners, welds, or other similar means. Other embodiments of the frame 202 may include one, three, or more vertical members 218, or the vertical members 218 may be omitted. In another embodiment, horizontal members (not shown) may extend between the side members 210 in addition to or instead of the vertical members 218.

As shown in FIG. 2, the lower support bracket 208 is coupled to the vertical members 218. The lower support bracket 208 may consist of two parallel arms 220 and two cross braces 222 (one indicated) positioned between the parallel arms 220 and retained using fasteners, welds, or other similar means. Other embodiments of the adjustable wall mount assembly 102 may include one, three, or more cross braces 222, or the cross braces 222 may be omitted. The lower support bracket 208 may be rotatably coupled to the vertical members 218 using one or more bolts or pins 224. In another embodiment, the lower support bracket 208 may be a solid piece of material (not shown) with a hole cut out for the actuator 106.

The actuator brackets 206 may each include a first arm 226 (one indicated) and a second arm 228 (one indicated), as shown in the exemplary embodiment. Each first arm 226 may be rotatably coupled to a side member 210 of the frame 202 opposite the respective support 204 using a single bolt or pin assembly 230, as shown in FIG. 2. Each second arm 228 may be coupled to the frame 202 below the respective first arm 226 using similar means. In another embodiment, the first arm 226 may be coupled to the respective side member 210 at a different location than the support 204. Other embodiments of the actuator bracket 206 may have one, three, or more arms.

The actuator brackets 206 may also be coupled to the actuator 106. Both the first arm 226 and second arm 228 of each actuator bracket 206 may be coupled to a common location 232 as shown in FIG. 2. A single bolt or pin assembly 234 may couple the two actuator brackets 206 to the actuator 106 and allow the actuator brackets 206 to rotate. In another embodiment, the first arms 226 may be rotatably coupled to the actuator 106 at a first common location 232 and the second arms 228 may be rotatably coupled to the actuator 106 at a second common location (not shown).

Other embodiments of the adjustable wall mount assembly 102 may include an upper support bracket instead of or in addition to the lower support bracket 208. The upper support bracket may be similar in construction to the lower support bracket 208 and be positioned above the actuator brackets 206. In such embodiments, the upper support bracket may be rotatably coupled to the actuator 106 at location 232 and the actuator brackets 206 may be coupled to the actuator 106 at a common location below the upper support bracket, such as location 236.

Figure 3:
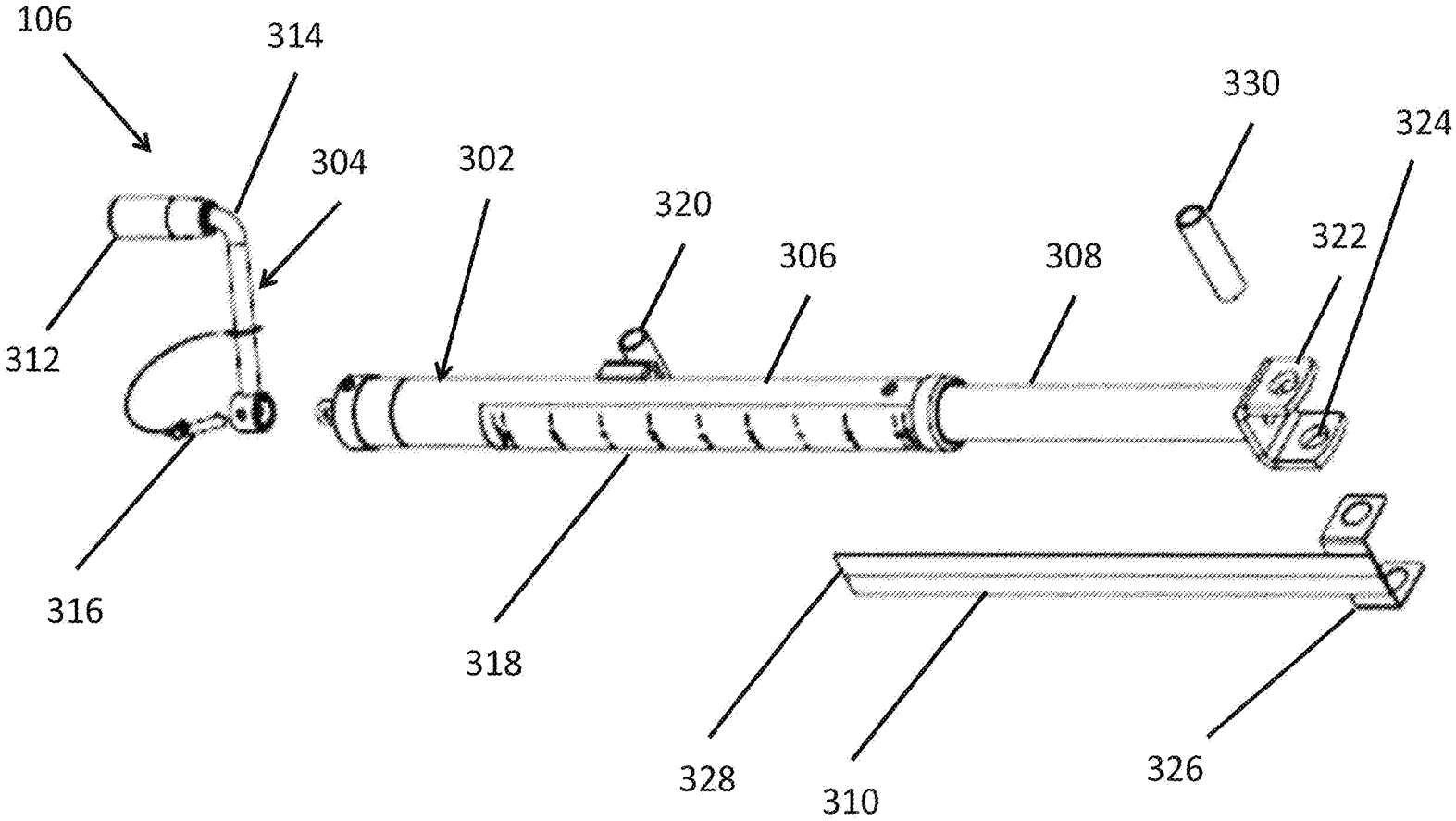
FIG. 3 illustrates an exploded view of an actuator, as may be used in the embodiment of FIG. 1.
Figure 4:
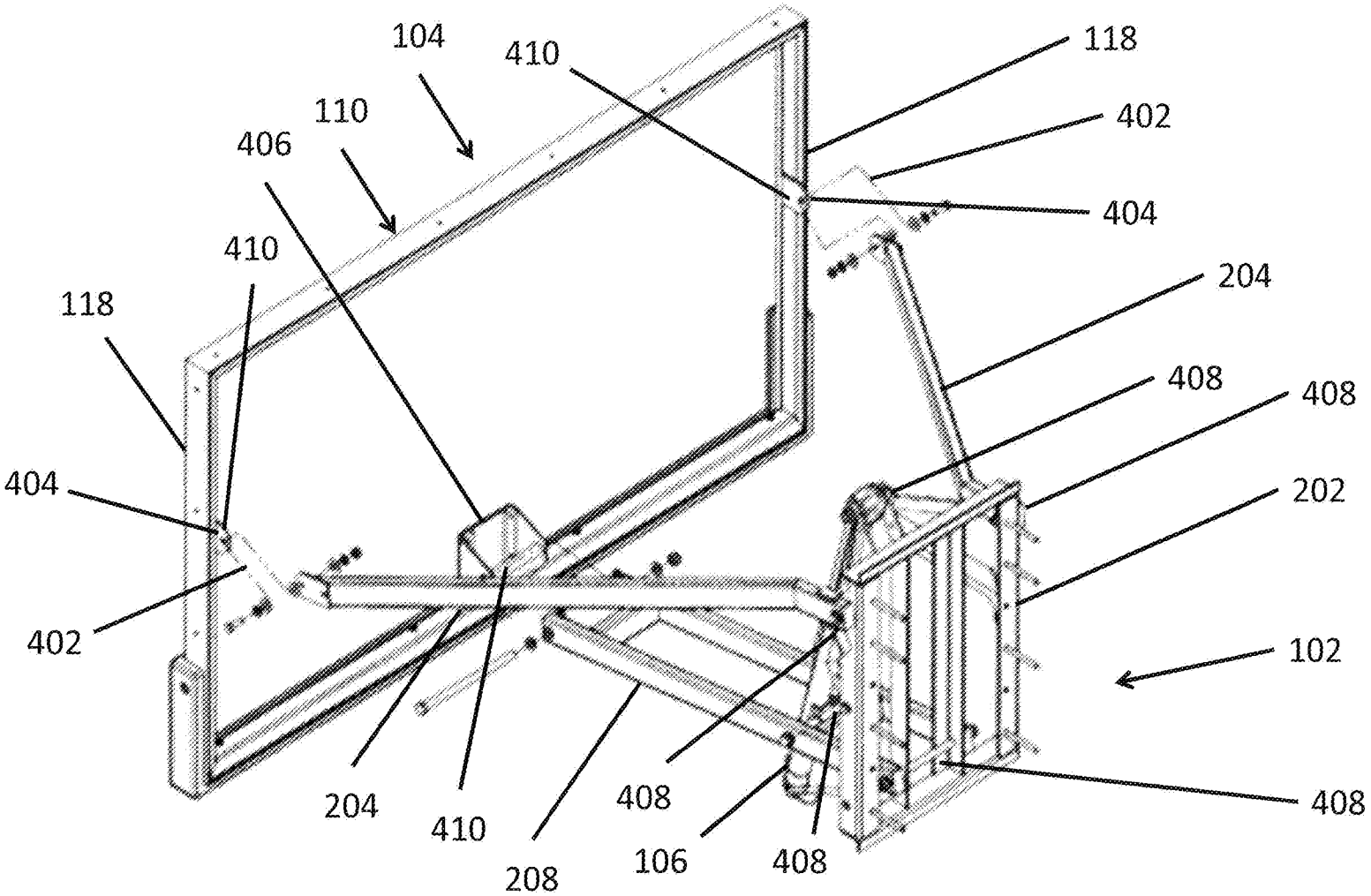
FIG. 4 illustrates the backboard frame and the adjustable wall mount assembly of FIG. 1 from the obverse perspective.

Referring now to FIG. 3, with continued reference to FIGS. 1 and 2, FIG. 3 illustrates an exploded view of an actuator 106, as may be used in the embodiment of FIG. 1. In the example embodiment illustrated in FIG. 3, the actuator 106 is a hydraulic cylinder 302 that includes a handle 304, an outer cylinder 306, an inner rod 308, and a height indicator 310. Other embodiments of the actuator 106 may use a worm gear, pneumatic cylinder, or other similar device that can extend to raise or lower the adjustable, wall-mounted basketball goal 100.

The handle 304 may include a grip 312 and a shaft 314 that includes a bend. Other embodiments of the handle 304 may omit the grip 312, the bend, or both. The handle 304 may be removably coupled to the hydraulic cylinder 302 using a pin assembly 316, as shown in FIG. 3. In another embodiment, the handle 304 may be coupled to the hydraulic cylinder 302 using a bolt or permanently fixed to the hydraulic cylinder 302. The hydraulic cylinder 302 may be configured to extend when the handle 304 is rotated in one direction and retract when the handle 304 is rotated in the opposite direction. Other embodiments of the actuator 106 may extend or retract when the handle 304 is pulled at an angle or the handle 304 is pumped.

The hydraulic cylinder 302 may include a height gauge 318 on the exterior of the outer cylinder 306. The height gauge 318 may be a sticker adhered to the outer cylinder 306. In other embodiments, the height gauge 318 may be painted onto the outer cylinder 306 or etched into the outer cylinder 306. The hydraulic cylinder 304 may further include a tube 320 coupled to the outer cylinder 306 through welding or other similar means. The tube 320 may receive a bolt or pin to couple the hydraulic cylinder 302 to the lower support bracket 208 while still allowing rotation of the hydraulic cylinder 302 and lower support bracket 208 about the bolt or pin.

The inner rod 308 may include an end retained by the outer cylinder 306. In at least one embodiment, the inner rod 308 may be a hollow cylinder with plates welded or otherwise coupled to each end. In other embodiments, the inner rod 308 may be solid. The inner rod 308 may further include a mounting bracket 322 having a plurality of through holes 324, as shown in FIG. 3. The mounting bracket 322 may be coupled to the inner rod 308 using fasteners, welds, or other similar means.

The hydraulic cylinder 302 may also include the height indicator 310. The height indicator 310 may have a mounting bracket 326 that aligns with the mounting bracket 322 of the inner rod 308. In other embodiments, the height indicator 310 may be coupled to the mounting bracket 322 or the inner rod 308 using fasteners, welds, or other similar means. The edge 328 of the height indicator 310 may be positioned such that the height of the wall-mounted basketball goal 100 is indicated on height gauge 318.

The actuator 106 may further include a second tube 330 that may be inserted into the plurality of holes 324 on the mounting bracket 322 of the inner rod 308. The tube 330 may receive a bolt or pin to couple the hydraulic cylinder 302 to the actuator brackets 206 while still allowing rotation of the hydraulic cylinder 302 and actuator brackets 206 about the bolt or pin. The height indicator 310 may also be retained between the actuator brackets 206 by the bolt or pin.

With continued reference to FIGS. 1, 2, and 3, FIG. 4 illustrates the backboard frame 110 and the adjustable wall mount assembly 102 of FIG. 1 from the obverse perspective. In the exemplary embodiment, the supports 204 and lower support bracket 208 are coupled to the backboard frame 110 using bolts, as indicated in phantom lines 402. The bolts may allow for rotational movement of the backboard frame 110. Other embodiments of the wall-mounted basketball goal 100 may use pin assemblies in place of the bolts.

The supports 204 may be coupled to tabs 404. The tabs 404 may be coupled to the side members 118 of the backboard frame 110 using fasteners, welds, or other similar means. The backboard frame 110 may also include a mounting bracket 406 that is coupled to the lower support bracket 208 using bolts or pins. The mounting bracket 406 may be coupled to the backboard frame 110 using fasteners, welds, or other similar means. The mounting bracket 406 may also be used to mount the rim assembly 126.

In operation, the actuator 106 may be extended to lower the adjustable, wall-mounted basketball goal 100 and retracted to raise the adjustable, wall-mounted basketball goal 100. Other embodiments of the adjustable, wall-mounted basketball goal 100 may be configured to raise the adjustable, wall-mounted basketball goal 100 as the actuator 106 is extended, and retract the adjustable, wall-mounted basketball goal 100 as the actuator 106 is retracted. Relative movement at the points 408 permit the lower support bracket 208 and supports 204 to move relative to the frame 202 as the actuator 106 raises or lowers the backboard 104. Similarly, relative movement at the points 410 permit the lower support bracket 208 and supports 204 to move relative to the backboard 104 and maintain the backboard 104 in its proper orientation. In the exemplary embodiment, the handle 304 may be removed after the adjustable wall-mounted basketball goal 100 reaches the desired height to prevent damage to the actuator 106.

The foregoing has outlined features of several embodiments so that those skilled in the art may better understand the present disclosure. Those skilled in the art should appreciate that, they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

Additionally, the description herein uses terms such as 'lower', 'upper', etc., that are relative in nature. Those skilled in the art and having the benefit of this disclosure will appreciate that these terms are used relative to the orientation of an adjustable wall mount assembly in use with a backboard, as in, for example, FIG. 1.

I claim:

1. An adjustable wall mount assembly for a basketball goal, comprising:

a lower support bracket;

a wall mount assembly frame having opposing left-side and right-side members, opposing top and bottom members, and a pair of vertical members spanning between the top and the bottom members and interior to the left-side and right-side members;

a pair of upper supports each having a first end and a second end, each upper support rotatably coupled to a respective one of the left-side and right-side members of the wall mount assembly frame at the first end and each tapering out to and adapted to be rotatably coupled at the second end to an upper portion of a respective first and a second outer side member of a frame of a backboard;

an actuator comprising:

an outer cylinder; and an inner rod with an exposed end;

a first pair of actuator brackets each having a first end and a second end, each of the first pair of actuator brackets rotatably coupled, at the first end, to a portion of the left-side member of the wall mount assembly frame between the top member and the bottom member, each of the first pair of actuator brackets tapering away from the left-side member and adapted to be rotatably coupled to a first common point of the exposed end of the inner rod at the second end of each of the first pair of actuator brackets;

a second pair of actuator brackets each having a first end and a second end, each of the second pair of actuator brackets rotatably coupled, at the first end, to a portion of the right-side member of the wall mount assembly frame between the top member and the bottom member, and each tapering away from the right-side member and adapted to be rotatably coupled to the common point of the exposed end of the inner rod at the second end of each of the second pair of actuator brackets; and the lower support bracket comprising:

two parallel arms, each having a first end adapted to be rotatably coupled to a mounting bracket on the frame of the backboard and a second end rotatably coupled to a respective vertical member of the wall mount assembly frame.

2. The adjustable wall mount assembly of claim 1, wherein the actuator comprises a hydraulic cylinder.

3. The adjustable wall mount assembly of claim 1, wherein the actuator comprises a worm gear.

4. The adjustable wall mount assembly of claim 1, wherein the actuator comprises a height gauge and a height indicator.

5. The adjustable wall mount assembly of claim 1, wherein extending the actuator lowers the backboard.

6. The adjustable wall mount assembly of claim 1, wherein the actuator comprises a handle that rotates in a first direction to extend the actuator and rotates in a second direction to retract the actuator.

7. The adjustable wall mount assembly of claim 6, wherein the handle of the actuator is removable.

8. An adjustable basketball goal comprising:

a backboard comprising:

a backboard frame including a first outer side member, a second outer side member, a top member, and a bottom member; and a mounting bracket coupled to a midpoint of the bottom member of the backboard frame;

a rim assembly coupled to the backboard frame via a mounting plate attached to the mounting bracket; and a wall mount assembly comprising:

a lower support bracket;

a wall mount assembly frame having opposing left-side and right-side members, opposing top and bottom members, and a pair of vertical members spanning between the top and the bottom members and interior to the left-side and right-side members;

a pair of upper supports each having a first end and a second end, each upper support rotatably coupled to a respective one of the left-side and right-side members of the wall mount assembly frame at the first end and each tapering out to and adapted to be rotatably coupled at the second end to an upper portion of the first and second outer side member, respectively, of the backboard frame;

an actuator comprising:

an outer cylinder; and an inner rod with an exposed end protruding from the outer cylinder;

a first pair of actuator brackets each having a first end and a second end, each of the first pair of actuator brackets rotatably coupled, at the first end, to a portion of the respective left-side member of the wall mount assembly frame between the top member and the bottom member, each of the first pair of actuator brackets tapering away from the left-side member and adapted to be rotatably coupled at a first common point to the exposed end of the inner rod at the second end of each of the first pair of actuator brackets;

a second pair of actuator brackets each having a first end and a second end, each, of the second pair of actuator brackets rotatably coupled, at the first end, to a portion of the right-side member of the wall mount assembly frame between the top and bottom member, and each tapering away from the right-side member and adapted to be rotatably coupled to the first common point of the exposed inner rod at the second end of the second pair of actuator brackets; and the lower support bracket comprising:

two parallel arms, each having a first end adapted to be rotatably coupled to the mounting bracket and a second end rotatably coupled to a respective vertical member of the wall mount assembly frame.

9. The adjustable basketball goal of claim 8, wherein the actuator comprises a hydraulic cylinder.

10. The adjustable basketball goal of claim 8, wherein the actuator comprises a worm gear.

11. The adjustable basketball goal of claim 8, wherein the actuator comprises a height gauge and a height indicator.

12. The adjustable basketball goal of claim 8, wherein extending the actuator lowers the backboard.

13. The adjustable basketball goal of claim 8, wherein the actuator comprises a handle that rotates in a first direction to extend the actuator and rotates in a second direction to retract the actuator.

14. The adjustable basketball goal of claim 8, further comprising a panel retained by the backboard frame and made of glass, tempered glass, plexiglass, or polycarbonate.

15. An adjustable basketball goal comprising:

a wall mount assembly comprising:

a lower support bracket;

a wall mount assembly frame having opposing left-side and right-side members, opposing top and bottom members, and a pair of vertical members spanning between the top and bottom members in between the left-side and right-side members;

an actuator;

a first actuator bracket including a first angled arm and a second angled arm, each of the first angled arm and the second angled arm having a first end and a second end, the first end of the first angled arm and the first end of the second angled arm rotatably coupled to the left-side member of the wall mount assembly frame and the second end of the first angled arm and the second end of the second angled arm rotatably coupled at a first common point associated with the actuator;

a second actuator bracket including a third angled arm and a fourth angled arm, each of the third angled arm and the fourth angled arm having a first end and a second end, the first end of the third angled arm and the first end of the fourth angled arm rotatably coupled to the right-side member of the wall mount assembly frame and the second end of the third angled arm and the second end of the fourth angled arm rotatably coupled to the actuator at a second common point associated with the actuator;

a first upper support having a first end tapering out from and rotatably coupled to the left-side member of the wall mount assembly frame;

a second support having a first end tapering out from and rotatably coupled to the right-side member of the wall mount assembly frame; and the actuator comprising:

an inner rod partially disposed within an outer cylinder and an exposed end of the inner rod rotatably coupled to the first actuator bracket at the first common point and the second actuator bracket at the second common point;

a backboard frame comprising:

a first side member rotatably coupled to a second end of the first upper support;

a second side member rotatably coupled to a second end of the second upper support; and a mounting bracket attached to a lower member of the backboard frame;

the lower support bracket comprising:

two parallel arms having a first end rotatably coupled to the mounting bracket and a second end rotatably coupled to a respective vertical member of the wall mount assembly frame;

a rim assembly coupled to the backboard frame via a mounting plate connected to the mounting bracket.

16. The adjustable basketball goal of claim 15, wherein extending the actuator lowers the backboard.

17. The adjustable basketball goal of claim 15, further comprising a panel retained by the backboard frame and made of glass, tempered glass, plexiglass, or polycarbonate.

* * * * *